US005170022A

United States Patent [19]

Bouron

[11] Patent Number: 5,170,022

[45] Date of Patent: Dec. 8, 1992

[54] ELECTROMECHANICAL PROGRAMMER WITH SMOOTH PROGRAM PRESELECTION

[75] Inventor: Michel Bouron, La Roche Sur Yon, France

[73] Assignee: Esswein S.A., La Roche Sur Yon, France

[21] Appl. No.: 709,205

[22] Filed: Jun. 3, 1991

[30] Foreign Application Priority Data

Jun. 1, 1990 [FR] France ..... 90 06875

[51] Int. Cl.[5] ..... H01H 43/00

[52] U.S. Cl. ..... 200/38 R; 200/38 A; 200/38 B; 200/38 C

[58] Field of Search ..... 200/35 R, 38 R, 38 A, 200/38 B, 38 C, 38 BA, 38 CA; 367/141, 141.4

[56] References Cited

U.S. PATENT DOCUMENTS

| | | | |
|---|---|---|---|
| 3,319,019 | 5/1967 | Davin | 200/38 R |
| 3,373,253 | 3/1968 | Davin | 200/38 R |
| 3,449,699 | 6/1969 | Davin | 200/38 BX |
| 3,596,015 | 7/1971 | Davin | 200/38 R |
| 4,146,760 | 3/1979 | Voland | 200/38 A |
| 4,892,982 | 1/1990 | Hueber et al. | 200/38 R |
| 4,948,928 | 8/1990 | Willigman | 200/38 R |

*Primary Examiner*—J. R. Scott

*Attorney, Agent, or Firm*—Oblon, Spivak, McClelland, Maier & Neustadt

[57] ABSTRACT

A electromechanical programmer with smooth program preselection having a rotating main cam unit for executing several operating programs, a first cam for allowing step passage with the main cam unit driven in rotation by a micromotor through a speed reduction system, and a second cam for smooth program preselection. The programmer comprises a retractable mechanical drive device for assuring a mechanical connection between the rotating main cam unit and first cam for allowing step passage under a control of the second cam for smooth program preselection.

8 Claims, 2 Drawing Sheets

ELECTROMECHANICAL PROGRAMMER WITH SMOOTH PROGRAM PRESELECTION

BACKGROUND OF THE INVENTION

1. Field of the Invention

The present invention relates to an electromechanical programmer with smooth program preselection.

2. Description of the Related Art

Devices such as washing machines and dishwashers usually comprise programmers which assure the sequence of operations to be executed by these devices, provided in preestablished operating programs. The programmers with smooth program preselection make it possible for the users of these washing machines or dishwashers to choose one of these operating programs in starting these devices.

The known electromechanical programmers with smooth program preselection often comprise two micromotors the first of which step by step drives—during a normal sequence of an operating program by a reducer or a speed reduction program driving a cam for allowing step passage and a passage actuating lever—a main cam unit which actuates switches or electric contacts for supplying electric current to the various electric elements of the devices on which these programmers are mounted, and the second drives this main cam unit through a reducer or a speed reduction system in a smooth preselection of a program where the switches or electric contacts associated with this main cam unit are previously turned off. The rotation of the main cam unit of these programmers without smooth preselection often requires a relatively great manual effort which can be difficult for the users. For this reason, in this programmer, the second micromotor drives this main cam unit instead of the users and the preselection of a program becomes smooth for the latter.

In some known programmers, the second micromotor is replaced by a clutch system with gears controlled by an electromagnet which is combined with the speed reduction system of the first micromotor to drive the main cam unit in a smooth preselection of a program.

Such structures prove particularly costly because they require either use of two micromotors and two reducers or speed reduction systems in the same programmer, or use of a micromotor of a speed reduction system and a clutch system with gears and with control by an electromagnet in the same programmer.

SUMMARY OF THE INVENTION

An object of the present invention is to avoid the above-mentioned drawbacks by providing for an economical electromechanical programmer with smooth program preselection.

According to the present invention, the electromechanical programmer with smooth program preselection comprises a rotating main cam unit for executing several operating programs; a first cam for allowing a step passage to the main cam unit, the first cam being rotatably driven by a micromotor through a speed reduction system; a second cam for smooth program preselection; and a retractable mechanical drive device for assuring a mechanical connection between the rotating main cam unit and the first cam for allowing step passage under a control of the second cam for a smooth program preselection.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
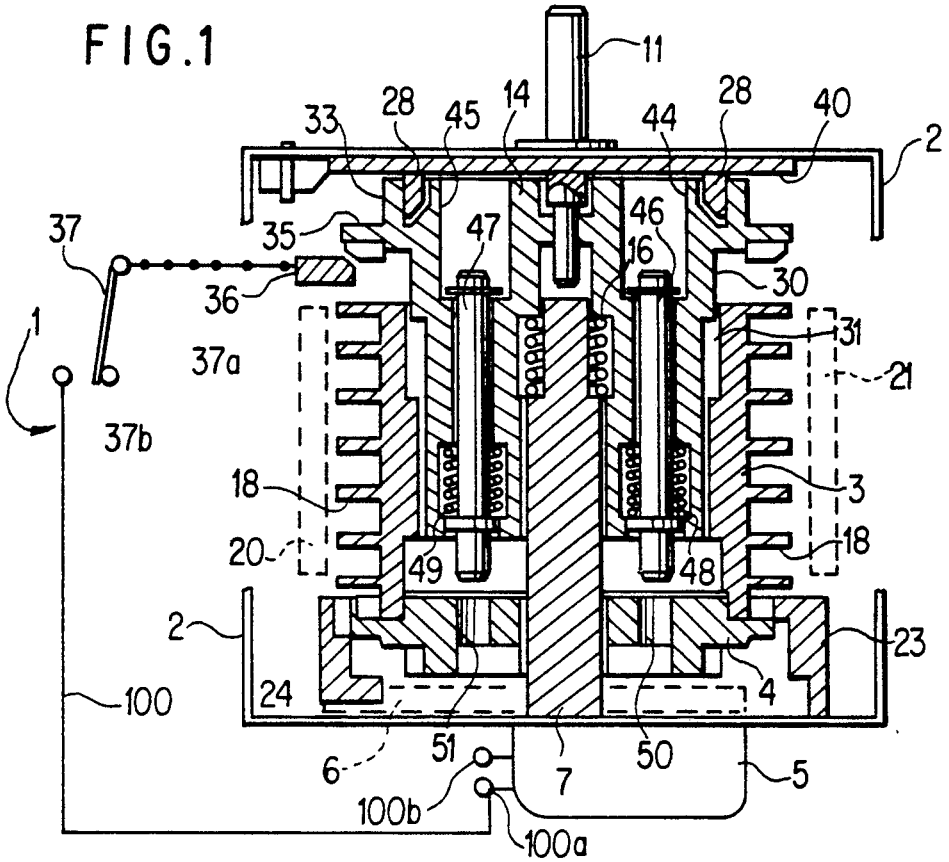
FIG. 1 represents a partial diagrammatic view in axial section of an electromechanical programmer with smooth program preselection according to the invention, showing it in its state of rest or normal operation.

Referring now to the drawings, wherein like reference numerals designate identical or corresponding parts throughout the several views, and more particularly to FIG. 1 thereof, FIG. 1 shows an electromechanical programmer with smooth program preselection 1, which comprises a frame 2, a rotating main cam unit 3 for executing several operating programs, a cam 4 for allowing step passage to the main cam unit 3, mounted coaxially at a first end of the main cam unit 3 and driven in rotation around a stationary shaft 7 by a micromotor 5 through a reducer or speed reduction system 6 represented in dashes, a cam 10 for smooth program preselection mounted close to the second end of the main cam unit 3, coaxial with the latter, mobile in rotation and able to be adjusted in angular position by a manual control rotary shaft 11.

Figure 3:
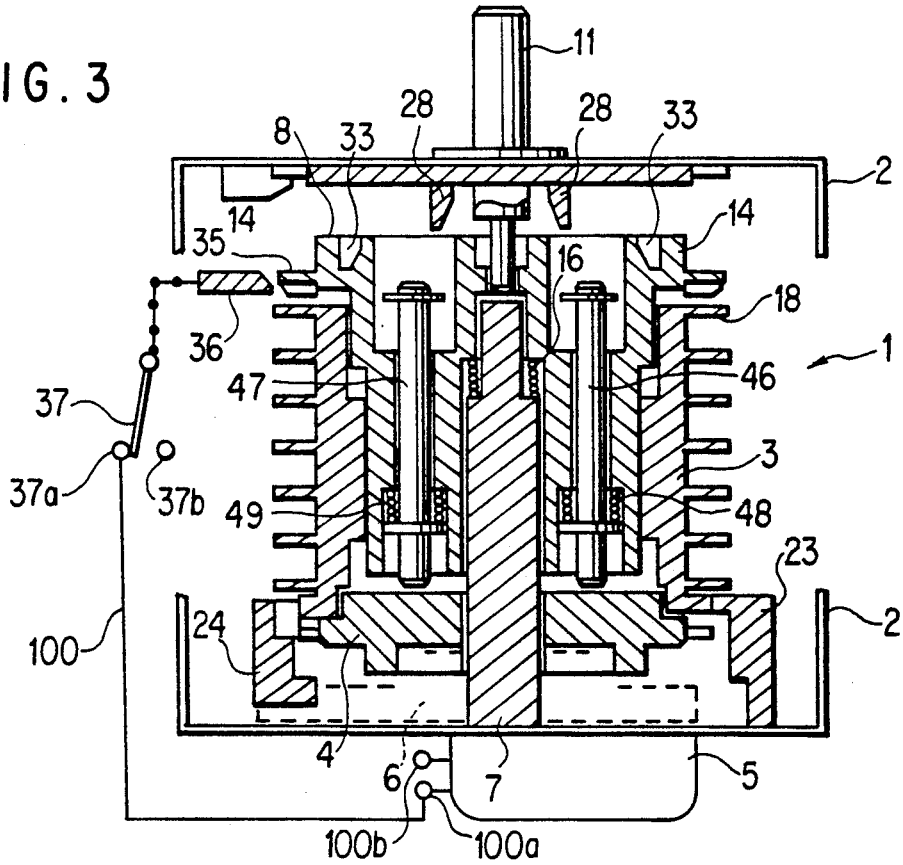
FIG. 3 represents a partial diagrammatic view, in axial section of the programmer of FIG. 1, showing it in another state in a preselection of an operating program.
Figure 2:
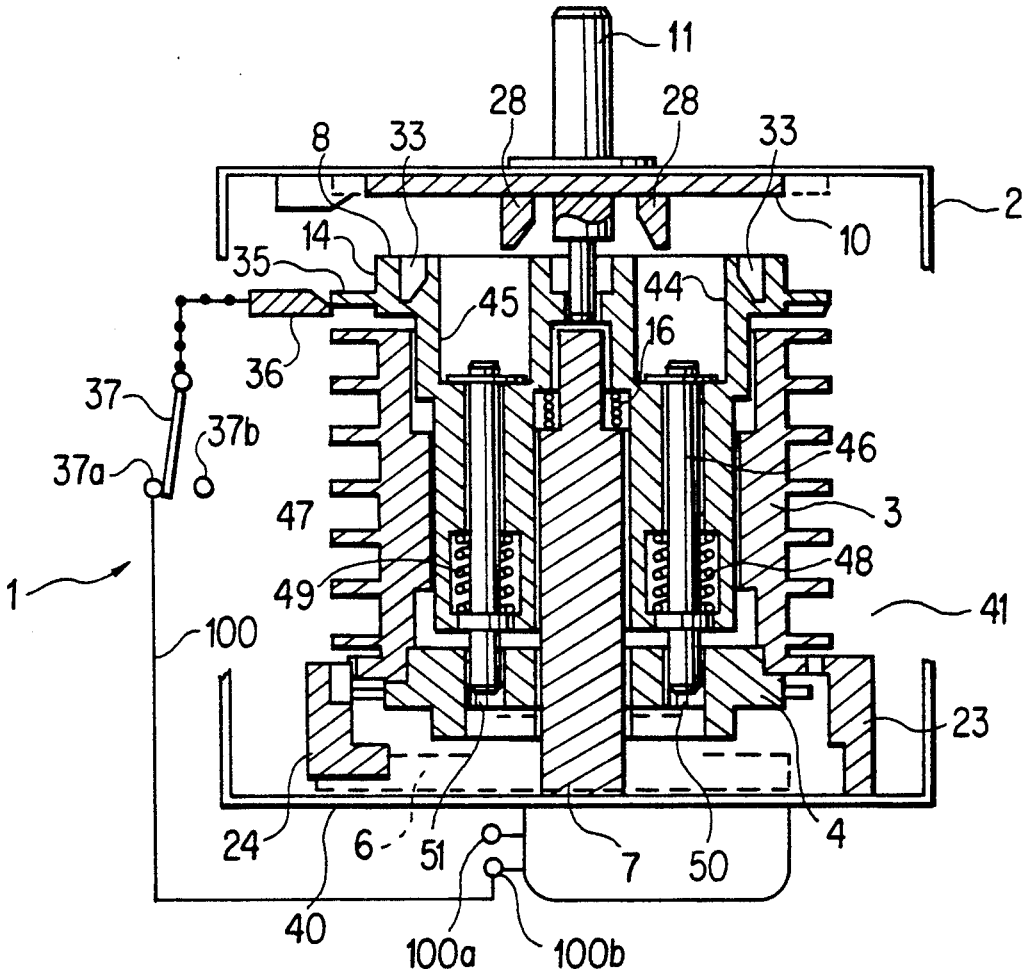
FIG. 2 represents a partial diagrammatic view in axial section of the programmer of FIG. 1, showing it in a state in a preselection of an operating program.

According to the invention, programmer 1 comprises a retractable mechanical drive device 8, see FIGS. 2 and 3, assuring a mechanical connection between rotating main cam unit 3 and cam 4 for allowing step passage, under control of cam 10 for smooth program preselection.

Retractable mechanical drive device 8 comprises, on the one hand, a program preselection cam follower 14 combined with cam 10 for smooth program preselection, and, on the other hand, retractable means for mechanical liaison between program preselection cam follower 14 and cam 4 for allowing step passage and slidable mechanical connection means between program preselection cam follower 14 and main cam unit 3.

In illustrated programmer 1, micromotor 5 drives main cam unit 3 along two paths or mechanical chains 40 and 41. First mechanical chain 40 comprises reducer or speed reduction system 6, cam 4 for allowing step passage, a disengageable eccentric passage actuating lever 24 and a positioning lever 23 mounted at a first end of this main cam unit 3, and second mechanical chain 41 comprises speed reducer 6 and cam 4 for allowing step passage which are common to first and second mechanical chains 40 and 41 and retractable mechanical drive device 8 which comprises, on the one hand, program preselection cam follower 14 mounted between program preselection cam 10 and the second end of main cam unit 3, sliding axially in this main cam unit 3 and retractable mechanical connection means 44 to 51 between cam 4 for allowing step passage and program preselection cam follower 14 and slidable mechanical connection means 30, 31 between main cam unit 3 and program preselection cam follower 14. Micromotor 5 drives main cam unit 3 by this first mechanical chain 40 during a normal sequence of an operating program and by this second mechanical chain 41 in a smooth preselection of an operating program.

Rotating main cam unit 3 controls by its cams 18 the switches or stationary electric contacts which form stationary networks of contacts 20, 21 represented in dashes and supply electric current to micromotor 5 of programmer 1 and to the various electric elements of an electric household device not represented, such as a washing machine, dishwasher on which this programmer 1 is mounted. The rotation movement of main cam unit 3 depends both on a positioning lever 23 which keeps the latter in position and an eccentric passage actuating lever 24 which is controlled by cam 4 for allowing step passage and makes this main cam unit 3 advance. Positioning lever 23 and eccentric passage actuating lever 24 are levers of known types.

Main cam unit 3 advances one step when cam 4 for allowing step passage acts on eccentric passage actuating lever 24 which pushes cam unit 3. Cam 10 for smooth program preselection rotated manually by shaft 11 comprises in its active axial surface two axial projections 28 which are intended to trigger the beginning of the sequence of the preselected operating program.

Program preselection cam follower 14, which can be moved axially inside of main cam unit 3, carries at its periphery spaced longitudinal ribs 30 which slide in corresponding longitudinal grooves 31formed in the inside walls of main cam unit 3. Spaced longitudinal ribs 30 of preselection cam follower 14 and longitudinal grooves 31 of main cam unit 3 constitute slidable mechanical connection means that make it possible for preselection cam follower 14 to slide inside main cam unit 3 and be integral in rotation with the latter.

In a variant embodiment, main cam unit 3 carries spaced longitudinal ribs and preselection cam follower 14 is equipped with corresponding longitudinal grooves.

Program preselection cam follower 14 further comprises, in its end adjacent to cam 10 for smooth program preselection, recesses 33 which are used as housings for axial projections 28 of cam 10 for smooth program preselection and, in its periphery of its end, a lateral flange 35 intended to control through an actuating lever 36 an electric contact 37 having terminals 37*a* and 37*b* for supply of micromotor 5 through electrical line 100 and terminals 100*a* and 100*b*.

Program preselection cam follower 14 is provided with an axial hole in its center, intended to receive rotation shaft 7 and return spring 16, and symmetrically and parallel to its longitudinal axis, two receiving and guiding longitudinal holes 44, 45 whose ends have larger diameters than those of the central parts and two retractable longitudinal locking rods 46 and 47 mounted to slide in longitudinal guide holes 44 and 45 and constantly returned elastically projecting toward the outside in the direction of cam 4 for allowing step passage by springs 48, 49, and cam 4 for allowing step passage comprises two longitudinal reception holes 50, 51 which are respectively aligned with locking rods 46, 47 when programmer 1 is in its state or position of rest illustrated in FIG. 1 and intended to receive the projecting ends of these locking rods 46, 47. Retractable locking rods 46, 47, guide holes 44 and 45 in program preselection cam follower 14 and reception holes 50, 51 in cam 4 for allowing step passage work with one another and form retractable mechanical connection means between the cam 4 for allowing step passage and program preselection cam follower 14.

The ends with broadened diameters of longitudinal guide holes 44, 45 of program preselection cam follower 14 are used both to house return springs 48, 49 and the heads of locking rods 46, 47 and to facilitate their movement.

Programmer 1 being in its state or position of rest represented in FIG. 1, during a smooth preselection of a program, preselection cam 10 is rotated with the help of maneuvering shaft 11 to a predetermined position indicated in an adjusting dial, not represented, corresponding to this program. During the rotation of the cam 10 for smooth program preselection, axial projections 28 are disengaged from their housings 33 by pushing and by moving away preselection cam follower 14 and slide over the end surface of the latter while this preselection cam follower 14 moves axially inside main cam unit 3, the projecting ends of its longitudinal locking rods 46, 47 carried by this preselection cam follower 14 are inserted in reception holes 50, 51 of cam 4 for allowing step passage and establish a mechanical connection which makes this preselection cam follower 14 and this cam 4 for allowing step passage integral in rotation, and at the end of the course of movement of this preselection cam follower 14, its lateral flange 35 pushes actuating lever 36 which throws electric contact 37 (FIGS. 1 and 2), triggers the power supply of micromotor 5 and cuts off electric contact networks 20 and 21 controlled by cams 18 of main cam unit 3.

Micromotor 5 then drives cam 4 for allowing step passage in rotation by reducer or speed reduction system 6. In its rotation, cam 4 for allowing step passage actuates eccentric step passage lever 24 then keeps it disengaged from main cam unit 3 and thus disconnects first mechanical chain 40. The rotation of cam 4 for allowing step passage continues and this cam 4 drives this main cam unit 3 in rotation by second mechanical chain 41 through preselection cam follower 14 due to the mechanical connections between cam 4 for allowing step passage and program preselection cam follower 14 by locking rods 46, 47 and between preselection cam follower 14 and main cam unit 3 by longitudinal ribs 30 and longitudinal grooves 31. Micromotor 5 thus drives preselection cam follower 14 and main cam unit 3 in rotation until recesses or housings 33 of program preselection cam follower 14 are again in front of projections 28 of cam 10 for smooth program preselection. In other words, main cam unit 3 is rotated a predetermined angle to exhibit at the outset the beginning of the selected program.

Under the thrust of return spring 16, projections 28 reenter their housings 33 and program preselection cam follower 14 again is applied against cam 10 for smooth program preselection as FIG. 1 shows. At the same time, locking rods 46, 47 are withdrawn from holes 50, 51 and lateral flange 35 releases actuating lever 36, allows electric contact 37 to be reversed and triggers a power supply cutoff of micromotor 5 through this contact 37. Second mechanical chain 41 is then disconnected.

An end of smooth preselection of a program and a beginning of a normal sequence of the selected program are reflected by application of voltage by contacts of contact networks 20, 21 by cams 18 of main cam unit 3, and by a supply of micromotor 5 no longer by contact 37 but by contacts of these networks 20 and 21.

In this normal sequence of the selected program, micromotor 5 drives main cam unit 3 in rotation by first mechanical chain 40 which comprises speed reducer 6, cam 4 for allowing step passage, positioning lever 23, second mechanical chain 41 being disconnected.

In the case where programmer 1 is not in a state or position of rest represented in FIG. 1 but is stopped in any position whatsoever, represented in FIG. 3 during a preselection of a program, cam 10 for smooth program preselection is rotated by maneuvering shaft 11 to a predetermined position corresponding to this program.

During the rotation of this cam 10 for smooth program preselection, axial projections 28 are disengaged from their housings 33 and slide over the end surface of this preselection cam follower 14 while preselection cam follower 14 moves axially inside main cam unit 3, the projecting ends of locking rods 46, 47 strike the surface of cam 4 for allowing step passage, make these locking rods retract or reenter partially in guide holes 44, 45 and compress their return springs 48, 49, since reception holes 50, 51 are not at that time aligned with these locking rods, and lateral flange 35, at the end of the course of movement of preselection cam follower 14, comes to push actuating lever 36 which throws contact 37 (FIG. 3), triggers the power supply of micromotor 5 and cuts off electric contact networks 20, 21 controlled by cams 18 of main cam unit 3.

Micromotor 5 rotates and drives cam 4 for allowing step passage in rotation by reducer or speed reduction system 6. In its rotation, cam 4 for allowing step passage actuates eccentric passage actuating lever 24 then keeps it disengaged from main cam unit 3 and thus disconnects first mechanical chain 40.

Cam 4 for allowing step passage continues to rotate, which makes it possible for the projecting ends of locking rods 46, 47 to slide over its surface. As soon as reception holes 50, 51 are in front of these ends, locking rods 46, 47 penetrate there with the thrust of their return springs 48, 49 and establish a mechanical connection which makes preselection cam follower 14 and cam 4 for allowing step passage integral in rotation as FIG. 2 illustrates.

Micromotor 5, which continues to rotate, then drives main cam unit 3 in rotation by second mechanical chain 41 which comprises speed reducer 6, cam 4 for allowing step passage, locking rods 46, 47 and program preselection cam follower 14, until housings 33 of preselection cam follower 14 are in front of projections 28 of cam 10 for smooth program preselection. Under the thrust of return spring 16, these projections 28 reenter their housings 33, preselection cam follower 14 is applied against cam 10 for smooth program preselection, and at the same time, locking rods 46, 47 are withdrawn from reception holes 50, 51 and lateral flange 35 releases actuating lever 36, allows contact 37 to be reversed and triggers a power supply cutoff of the micromotor through this contact 37. The preselection of a program comes to an end and the normal sequence of the selected program begins. Micromotor 5 is then supplied by electric contacts of networks and 21 of programmer 1 and drives main cam unit 3 in rotation by first mechanical chain 40 already described in one of the preceding paragraphs.

In a further embodiment not represented, the programmer comprises as retractable mechanical connection means between cam 4 for allowing step passage and program preselection cam follower 14, on the one hand, a single retractable longitudinal locking rod 46 or 47, guided through a single longitudinal reception hole 44 or 45 carried by program preselection cam follower 14 and constantly returned elastically projecting toward the outside of this cam follower 14 in the direction of cam 4 for allowing step passage by a spring 48 or 49 and, on the other hand, a single longitudinal reception hole 50 or 51 formed in cam 4 for allowing step passage and intended to receive the projecting end of this locking rod 46 or 47.

The operating of the programmer according to this further embodiment is similar to that of illustrated programmer 1.

The electromechanical programmer with smooth program preselection 1 described above thus has a particularly simple structure and can perform its work completely with the help of a single "drive micromotor 5—speed reducer" pair. This simplicity of structure and operation makes it particularly economical without its efficiency and its reliability being compromised.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Electromechanical programmer with smooth program preselection comprising:

a rotating main cam unit comprising means for actuating at least one switch for executing at least one operating program;

a first cam for providing a step-by-step rotation to said main cam unit, said first cam being rotatably driven by a micromotor through a speed reduction system;

a second cam for smooth program preselection; and a retractable mechanical drive device for providing a mechanical connection between said rotating main cam unit and said first cam under a control of said second cam for smooth program preselection;

wherein:

said retractable mechanical drive device comprises a program preselection cam follower combined with said second cam for smooth program preselection, retractable mechanical connection means between said program preselection cam follower and said first cam, and slidable mechanical connection means between said program preselection cam follower and said main cam unit; and said micromotor drives said main cam unit along two mechanical chains, the first chain of said two mechanical chains comprising a reducer or speed reduction system, said first cam, a disengageable eccentric passage actuating lever and a positioning lever mounted at a first end of said main cam unit; and the second chain of said two mechanical chains comprising said speed reducer and said first cam for allowing step passage which are common to said first and second mechanical chains, and said retractable mechanical drive device which comprises said program preselection cam follower mounted between said second cam for smooth program preselection and the second end of said main cam unit to slide axially in said main cam unit, and said retractable mechanical connection means between said first cam and said program preselection cam follower and said slidable mechanical connection means between said main cam unit and said program preselection cam follower.

2. The programmer according to claim 1, further comprising, as a retractable mechanical connection means between said first cam and said program preselection cam follower, at least one retractable longitudinal locking rod carried by said program preselection cam follower and constantly returned elastically projecting toward the outside of said cam follower in the direction of said first cam for allowing step passage by a spring, and at least one longitudinal reception hole formed in said first cam for receiving the projecting end of said locking rod.

3. The programmer according to claim 2, wherein said program preselection cam follower comprises symmetrically and parallel to its longitudinal axis, two longitudinal holes for receiving and guiding, in their sliding, said locking rods, said longitudinal holes having ends provided with larger diameters than those of their central parts for receiving and facilitating, in their movement, the heads of said locking rods and said return springs; and, in its center, an axial hole for receiving a rotation shaft and a spring which constantly returns said preselection cam follower to said second cam.

4. The programmer according to claim 1, further comprising, as slidable mechanical connection means between said main cam unit and said program preselection cam follower, spaced longitudinal ribs and corresponding longitudinal grooves respectively carried by said program preselection cam follower and said main cam unit.

5. The programmer according to claim 1, wherein said second cam for smooth program preselection carries spaced axial projections on an active surface, and said program preselection cam follower is equipped with corresponding recesses or housings in its end for receiving axial projections of said second cam for smooth program preselection.

6. The programmer according to claim 1, wherein said program preselection cam follower comprises, in the periphery of its end, a lateral flange for contacting an actuating lever so as to control an electric contact and provide a power supply to the micromotor.

7. The programmer according to claim 1, further comprising, as slidable mechanical connection means between said main cam unit and said program preselection cam follower, spaced longitudinal ribs and corresponding longitudinal grooves respectively carried by said main cam unit and said program preselection cam follower.

8. Electromechanical programmer with smooth program preselection comprising:

a rotating main cam unit comprising means for actuating at least one switch for executing at least one operating program;

a first cam for providing a step-by-step rotation to said main cam unit;

a micromotor for rotatably driving said first cam through a speed reducing means;

a second cam for smooth program preselection; and a retractable mechanical drive device for providing a mechanical connection between said rotating main cam unit and said first cam under a control of said second cam;

wherein:

said micromotor drives said main cam unit through first and second drive means, said first drive means comprising speed reducing means, said first cam, an eccentric actuating lever means, and a positioning lever means, said second drive means comprising said speed reducing means, said first cam, and said retractable mechanical drive device.

* * * * *